US006820767B2

(12) United States Patent
Nicholas

(10) Patent No.: US 6,820,767 B2
(45) Date of Patent: Nov. 23, 2004

(54) CONTAINER FOR STORING AND DISPENSING FOOD ITEMS AND BEVERAGES

(76) Inventor: Michael Edward Nicholas, R.R. #2, Blenheim, Ontario (CA), N0P 1A0

( * ) Notice: Subject to any disclaimer, the term of this patent is extended or adjusted under 35 U.S.C. 154(b) by 0 days.

(21) Appl. No.: 10/602,967

(22) Filed: Jun. 24, 2003

(65) Prior Publication Data

US 2004/0000565 A1 Jan. 1, 2004

(30) Foreign Application Priority Data

Jun. 27, 2002 (CA) ..... 2391823

(51) Int. Cl.[7] ..... B67D 5/60
(52) U.S. Cl. ..... 222/144.5; 222/132
(58) Field of Search ..... 222/144.5, 153.14, 222/132, 142.6, 142.9

(56) References Cited

U.S. PATENT DOCUMENTS

| | | | | |
|---|---|---|---|---|
| 1,667,818 | A | 5/1928 | Page | |
| 1,896,827 | A | 2/1933 | Neely | |
| 1,896,976 | A | 8/1933 | Schifferdecker | |
| 2,123,907 | A | 7/1938 | Masbach et al. | 221/64 |
| 2,581,713 | A | 1/1952 | Roubicek | 222/144.5 |
| 2,655,288 | A | 10/1953 | Caretto | 222/142.3 |
| 2,695,238 | A | 11/1954 | Ferguson | 99/171 |
| 2,731,013 | A | 1/1956 | Holmes | 128/272 |
| 2,903,127 | A | 9/1959 | Dorman | 206/56 |
| 3,144,152 | A | 8/1964 | Kopp | 215/6 |
| 3,235,130 | A | 2/1966 | Walther et al. | 222/142.9 |
| 3,767,087 | A | 10/1973 | Shannon | 222/144.5 |
| 3,831,743 | A | 8/1974 | Leedy | 206/338 |
| 4,065,536 | A | 12/1977 | Lucas | 264/98 |
| 4,164,301 | A | 8/1979 | Thayer | 220/253 |
| 4,261,468 | A | 4/1981 | Krebs | 206/538 |
| 4,301,942 | A | 11/1981 | Kupperman et al. | 220/444 |
| 4,583,667 | A | 4/1986 | Fishman et al. | 222/142.6 |
| 4,856,995 | A | 8/1989 | Wagner | 433/215 |
| 4,955,503 | A | 9/1990 | Propes | 220/526 |
| 5,060,811 | A | 10/1991 | Fox | 215/6 |
| 5,213,226 | A | 5/1993 | Nichols | 220/263 |
| 5,275,304 | A | 1/1994 | Abrams | 220/525 |
| 5,385,270 | A | 1/1995 | Cataneo et al. | 222/134 |
| 5,482,170 | A | 1/1996 | Semersky et al. | 215/6 |
| 5,588,550 | A | 12/1996 | Meyer | 220/525 |
| 5,588,561 | A | 12/1996 | Ness | 222/129 |
| 5,753,289 | A | 5/1998 | Ness | 426/394 |
| 5,758,786 | A | 6/1998 | John | 215/6 |
| 5,762,199 | A | 6/1998 | Aguilera | 206/533 |
| 5,794,819 | A | 8/1998 | Smith | 222/129 |
| 5,806,708 | A | 9/1998 | Schwab | 220/552 |
| 5,890,627 | A | 4/1999 | Storey | 222/129 |
| 5,921,440 | A | 7/1999 | Maines | 222/145.2 |
| 5,938,053 | A | 8/1999 | Verbovszky et al. | 215/6 |
| 5,941,420 | A | 8/1999 | Connan | 222/94 |
| 6,079,586 | A | 6/2000 | Hanneman | 220/526 |
| 6,189,738 | B1 | 2/2001 | Rosenthal | 222/144.5 |
| 6,283,316 | B1 | 9/2001 | Sherman | 215/6 |

*Primary Examiner*—Philippe Derakshani
(74) *Attorney, Agent, or Firm*—Kusner & Jaffe

(57) ABSTRACT

A container assembly for storing and dispensing food items and beverages having a vessel and a removable lid. The vessel defines a longitudinal axis and has a first tongue and groove member. The removable lid has a lid aperture for accessing an interior of the vessel, and a complementary mating second tongue and groove member that is rotatable with the lid about the longitudinal axis and relative to the first tongue and groove member of the vessel between a lid secured configuration and a lid releasing configuration. In the lid secured configuration, the tongue and groove members fully engage one another, preventing longitudinal movement of the lid member relative to the vessel. In the lid releasing configuration, the tongue and groove members are configured so as to permit longitudinal movement of the lid member relative to the vessel, and such that the lid member is removable from the vessel.

22 Claims, 6 Drawing Sheets

CONTAINER FOR STORING AND DISPENSING FOOD ITEMS AND BEVERAGES

FIELD OF THE INVENTION

The present invention relates to a container for storing and dispensing food items and beverages, and more particularly, to a container that has a vessel and a removable lid member with a lid aperture therethrough for accessing an interior of the vessel, with the lid member being rotatable between a tongue and groove lid secured configuration and a tongue and groove lid releasing configuration relative to the vessel.

BACKGROUND OF THE INVENTION

In the past, when faced with the prospect of storing and/or dispensing a number of different types of food items at the same time, a person would generally use a like number of different containers and/or snack bowls, one each for each different type of food item. This practice frequently resulted in an excessive use of containers and required a significant amount of space to effectively store same, a consideration that may be particularly acute when travelling or in other situations or locations where limited storage space is available. Likewise, this use of multiple containers required a significant amount of counter or table space to allow for the concurrent dispensing of food items contained therein and was relatively inefficient in this respect, especially insofar as a consumer using multiple containers and/or snack bowls was effectively required to juggle same when switching between different types of food items.

Containers having compartmented vessels with selectively rotatable dispensing lid members have been developed to overcome these problems and to better store and dispense one or more different types of food items, beverages, or the like, such as can be seen, for example, in U.S. Pat. No. 1,667,818 (Page) for a Canister and Like Box or Container, in U.S. Pat. No. 2,903,127 (Dorman) for a Dispensing and Storage Container, and in U.S. Pat. No. 5,890,627 (Storey) for an Apparatus, Adaptable to Sales Containers, For Volumetric Dispensing of Powdered Materials. The different containers disclosed by each of these three patents are all subject to a common problem, however, in that their respective lid members are either screw or snap fit onto their respective vessels. As such, the rotation of these lid members to selectively dispense the food items contained therein, and/or the removal of same to effectively allow their respective containers to be filled or re-filled with food items, requires the expenditure of significant effort and energy, such that weak or frail persons, including, without limitation, the very young, the very old, those with poor gripping ability, and sufferers of arthritis and other debilitating conditions, may not be equal to the task. In part because of the resulting difficulty that may be so associated with their opening and disassembly, these containers are neither adapted to be easily loaded, unloaded, nor to removal or interchanging of their respective partition members.

Accordingly, a primary object of the present invention is to provide a container assembly, for storing and dispensing food items and beverages, that has a removable lid member that is easily rotatable between a lid secured configuration and a lid releasing configuration.

Another object of one aspect of the invention is to provide a container assembly, for storing and dispensing food items and beverages, that has a rotatable lid member with a lid aperture therethrough for easily accessing an interior thereof.

A further object of one aspect of the invention is to provide a container assembly, for storing and dispensing food items and beverages, that is sealable so as to provide for the effective, secure and safe storage of food items and beverages.

An additional object of one aspect of the invention is to provide a container assembly, for storing and dispensing food items and beverages, that is subdivided into a plurality of substantially separate compartments so as to allow for substantially separate storage of a plurality of types of food items therewithin.

A still additional object of one aspect of the invention is to provide a container assembly, for storing and dispensing food items and beverages, that requires relatively little storage space.

A still further object of one aspect of the invention is to provide a container assembly, for storing and dispensing food items and beverages, that allows for efficient and selective dispensing of individual types of food item selected from the plurality of such types that may be stored therewithin.

A yet still further object of one aspect of the invention is to provide a container assembly, for storing and dispensing food items and beverages, that is simple and easy to use.

Another object of one aspect of the invention is to provide a container assembly, for storing and dispensing food items and beverages, that is easy to disassemble.

Yet another object of one aspect of the invention is to provide a container assembly, for storing and dispensing food items and beverages, that has a durable and reliable construction and is freezer, microwave, and dishwasher safe.

Still yet another object of one aspect of the invention is to provide a container assembly, for storing and dispensing food items and beverages, that reduces the risk of spillage or accidental loss of any food items or beverages that may be stored therewithin.

Another object of one aspect of the invention is to provide a container assembly, for storing and dispensing food items and beverages, that is inexpensive and easy to manufacture.

SUMMARY OF THE INVENTION

In accordance with a preferred embodiment of the present invention, there is disclosed a container assembly for storing and dispensing food items and beverages. The assembly comprises a vessel and a selectively removable lid member. The vessel defines a longitudinal axis, a bottom wall, and a continuous side wall that extends upwardly from the bottom wall toward a substantially annular rim portion. The rim portion defines a top opening to an interior of the vessel, and is shaped and dimensioned so as to define a first tongue and groove member. The selectively removable lid member has a perimeter lid portion surrounding a substantially circular central lid portion. The perimeter lid portion engages the rim portion of the vessel in substantially juxtaposed relation. The central lid portion is in substantially overlying relation with the top opening of the vessel. The central lid portion defines a lid aperture therethrough for accessing the interior of the vessel. According to this preferred embodiment of the present invention, the perimeter lid portion of the lid member is shaped and dimensioned so as to define a complementary mating second tongue and groove member that is rotatable with the lid member about the longitudinal axis and relative to the first tongue and groove member of the vessel between a lid secured configuration and a lid releasing configuration. The lid secured configuration is such that the tongue and groove members fully engage one another so as to prevent longitudinal movement of the lid member relative to the vessel. The lid releasing configuration is such that the tongue and groove members are configured with respect to one another so as to permit longitudinal movement of the lid member relative to the vessel. The lid member is removable from the vessel in the lid releasing configuration.

According to a further aspect of the preferred embodiment of the invention, the assembly further comprises a selectively removable blocking member having a perimeter blocking portion surrounding a central blocking portion. The perimeter blocking portion is substantially interposed in juxtaposed relation between the rim portion and the perimeter lid portion of the lid member. The central blocking portion is in substantially overlying relation with the top opening of the vessel, and is substantially interposed in at least partially obstructing relation between the lid aperture and the interior of the vessel. The blocking member is removable when the lid member is removed from the container assembly.

According to another aspect of the preferred embodiment of the invention, the assembly further comprises a selectively removable first partition member that engages an inner wall surface of the interior of the vessel so as to define at least two substantially separate longitudinal compartments within the interior. The first partition member is substantially interposed between the bottom wall and the central lid portion of the lid member. The lid aperture of the central lid portion is selectively and rotatably positionable, with rotation of the lid member in the lid secured configuration, to be in substantially overlying relation with respect to each of the compartments. The first partition member is removable through the top opening when the lid member and the blocking member are each respectively removed from the vessel.

According to a still further aspect of the preferred embodiment of the invention, the assembly further comprises a selectively removable second partition member that removably engages the first partition member and the inner wall surface of the vessel so as to together define at least three substantially separate longitudinal compartments within the interior. The second partition member is also substantially interposed between the bottom wall and the central lid portion of the lid member, and is removable through the top opening when the lid member and the blocking member are each respectively removed from the vessel.

According to an additional aspect of the preferred embodiment of the invention, the first tongue and groove member of the vessel defines an arcuate track groove and a first release groove. The arcuate track groove at least partially circumscribes the rim portion of the vessel in substantially transverse relation to the longitudinal axis. The first release groove extends substantially upwardly from the arcuate track groove to a rim top portion of the rim portion that is substantially adjacent to the top opening of the vessel. According to this additional aspect of the preferred embodiment of the invention, the complementary mating second tongue and groove member of the lid member comprises a first tongue member extending from the perimeter lid portion. The first tongue member is shaped and dimensioned to fully engage the arcuate track groove in the lid secured configuration. The first tongue member is further shaped and dimensioned so as to be aligned with, and removably passable through, the first release groove of the vessel in the lid releasing configuration.

According to a still yet further aspect of the preferred embodiment of the invention, the arcuate track groove and the first release groove are each respectively shaped in the rim portion in an outer wall surface of the vessel. According to this still yet further aspect of the preferred embodiment of the invention, the perimeter lid portion further comprises a downwardly directed skirt portion having an inner skirt surface. The first tongue member extends from the inner skirt surface in a first substantially inward direction.

According to a yet still further aspect of the invention, the inner wall surface of the interior of the vessel has a first elongate channel formed therein. The first elongate channel is adapted to receive a first lateral edge portion of the first partition member in removably secured sliding relation.

According to yet another aspect of the invention, the inner wall surface of the interior of the vessel has a second elongate channel formed therein. The second elongate channel is adapted to receive a second lateral edge portion of the first partition member in removably secured sliding relation.

According to a still further aspect of the invention, the first elongate channel and the second elongate channel of the inner wall of the vessel are each respectively substantially parallel to the, longitudinal axis.

According to a further aspect of the invention, the first elongate channel is in substantially diametrically opposed relation with the second elongate channel relative to the longitudinal axis.

According to a further aspect of the preferred embodiment of the invention, the first partition member and the second partition member are each respectively substantially planar in cross-section and substantially rectangular in shape. The first partition member and the second partition member each have a respective upper edge portion and a respective lower edge portion.

According to another aspect of the preferred embodiment of the invention, the first partition member and the second partition member are respectively further shaped so as to define a first longitudinal aperture and a second longitudinal aperture respectively therethrough. The first longitudinal aperture extends from the upper edge portion of the first partition member part way toward its respective lower edge portion. The second longitudinal aperture extends from the lower edge portion of the second partition member part way toward its respective upper edge portion. The first longitudinal aperture is adapted to removably engage the second partition member as aforesaid, whilst the second longitudinal aperture is adapted to removably engage the first partition member. The at least three substantially separate compartments comprise four substantially separate compartments. The second partition member is removable from the first partition member through the top opening when the lid member and the blocking member are each respectively removed from the vessel.

According to an additional aspect of the preferred embodiment of the invention, the perimeter blocking portion of the blocking member is shaped so as to define a first perimeter aperture therethrough. The first perimeter aperture is aligned with, and permits passage of, the first tongue member of the lid member, when it is further aligned with the first release groove of the vessel, in the lid releasing configuration.

According to a still yet further aspect of the preferred embodiment of the invention, the arcuate track groove of the vessel completely circumscribes the outer wall surface of the vessel. The second tongue and groove member together with the lid member is fully rotatable relative to the arcuate track groove of the first tongue and groove member and the vessel.

According to a yet still further aspect of the preferred embodiment of the invention, the first tongue and groove member further defines a second release groove shaped in the rim portion in the outer wall surface of the vessel. The second release groove extends substantially upwardly from the arcuate track groove to the rim top portion of the vessel. According to this yet still further aspect of the preferred embodiment of the invention, the second tongue and groove member further comprises a second tongue member that extends from the inner skirt surface in a second substantially inward direction. The second tongue member is shaped and dimensioned to fully engage the arcuate track groove in the lid secured configuration. The perimeter blocking portion of the blocking member is shaped so as to define a second perimeter aperture therethrough. The second tongue member is aligned with, and is removably passable through, the second release groove of the vessel and the second perimeter aperture of the blocking member in the lid releasing configuration.

According to yet another aspect of the preferred embodiment of the invention, the blocking member is in sealed and fully obstructed relation with respect to the interior of the vessel in the lid secured configuration.

According to another aspect of the preferred embodiment of the invention, each one of the compartments is of a substantially equal size to each respective other one. According to this aspect of the preferred embodiment of the invention, the lid aperture of the central lid portion is sized and shaped so as to be rotatably positionable, with rotation of the lid member, in substantially overlying relation with a selected single one of the compartments.

According to another aspect of the preferred embodiment of the invention, each one of the compartments is of a substantially equal size to each respective other one. According to this aspect of the preferred embodiment of the invention, the lid aperture of the central lid portion is sized and shaped so as to be rotatably positionable, with rotation of the lid member, in substantially overlying relation with a selected adjacent two of the compartments.

According to a still further aspect of the preferred embodiment of the invention, the continuous side wall of the vessel is substantially cylindrical in shape. Also according to this still further aspect of the preferred embodiment of the invention, the bottom wall and the blocking member are each respectively substantially planar in cross-section and circular in shape and substantially transverse to the longitudinal axis. Also according to this still further aspect of the preferred embodiment of the invention, the central lid portion is substantially planar in cross-section and substantially transverse to the longitudinal axis. Also according to this still further aspect of the preferred embodiment of the invention, the lid member is substantially circular in shape. Also according to this still further aspect of the preferred embodiment of the invention, the skirt portion completely circumscribes the perimeter lid portion of the lid member.

According to an additional aspect of the preferred embodiment of the invention, the first release groove and the second release groove are each respectively elongate in shape and substantially parallel to the longitudinal axis.

According to a still yet further aspect of the preferred embodiment of the invention, the vessel further comprises a handle member extending outwardly from the vessel.

According to another aspect of the preferred embodiment of the invention, with respect to the longitudinal axis, the first tongue member, the first release groove, and the first perimeter aperture of the blocking member are respectively in substantially diametrically opposed relation with the second tongue member, the second release groove, and the second perimeter aperture of the blocking member. As such, in the lid releasing configuration, each of the first tongue member and the second tongue member is removably passable through either of the first release groove and the first perimeter aperture or the second release groove and the second perimeter aperture of the blocking member.

BRIEF DESCRIPTION OF THE DRAWINGS

The novel features which are believed to be characteristic of the present invention, as to its structure, organization, use and method of operation, together with further objectives and advantages thereof, will be better understood from the following drawings, in which a presently preferred embodiment of the invention will now be illustrated by way of example. It is expressly understood, however, that the drawings are for the purpose of illustration and description only, and are not intended as a definition of the limits of the invention. In the accompanying drawings.

DETAILED DESCRIPTION OF A PREFERRED EMBODIMENT

Figure 1:
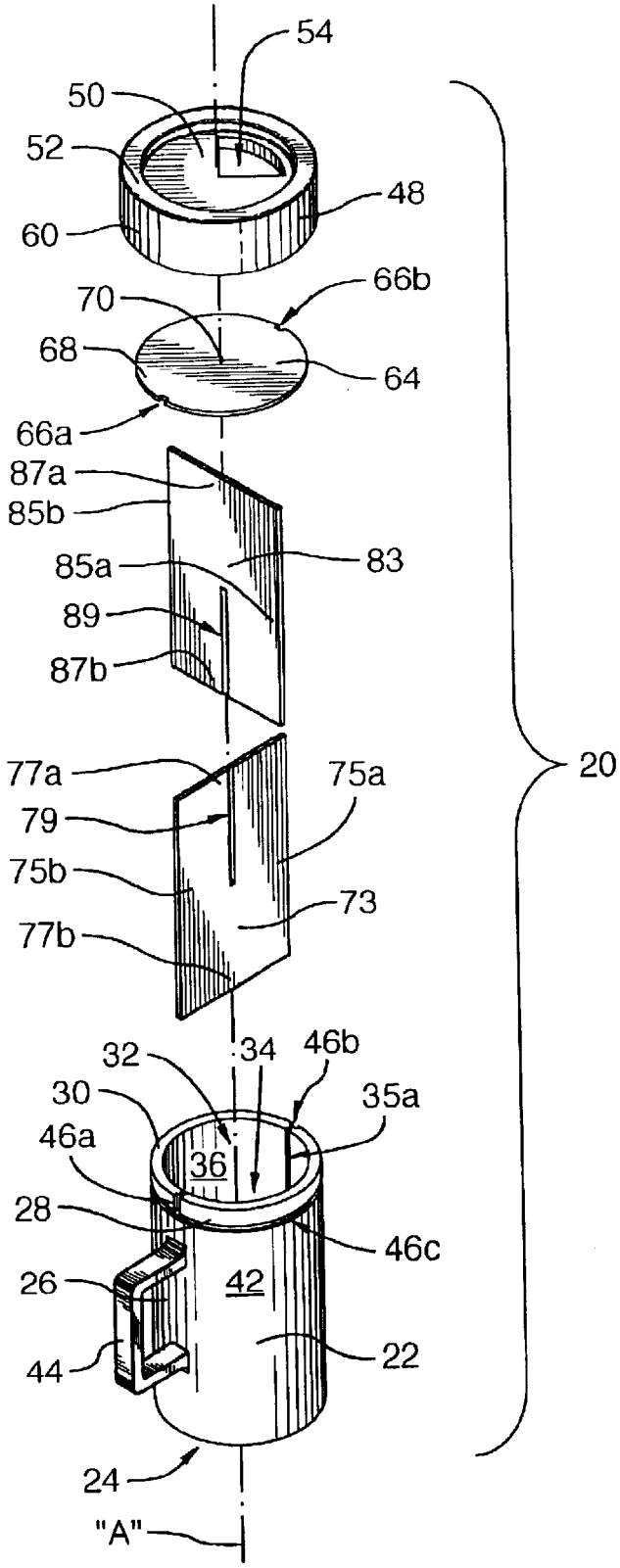
FIG. 1 is a top front left perspective exploded view of a container assembly for storing and dispensing food items and beverages according to the invention.

Referring now to FIG. 1 of the drawings, there is shown an exploded perspective view of a container assembly 20 for storing and dispensing food items and beverages (not shown), according to a preferred embodiment of the invention. The preferred embodiment of the assembly 20 shown in FIG. 1 consists of a vessel 22, a first partition member 73, a second partition member 83, a blocking member 64, and a lid member 48. As described in significantly more detail below, each of the first partition member 73, the second partition member 83, the blocking member 64, and the lid member 48 is selectively removable from the container assembly 20.

Figure 6:
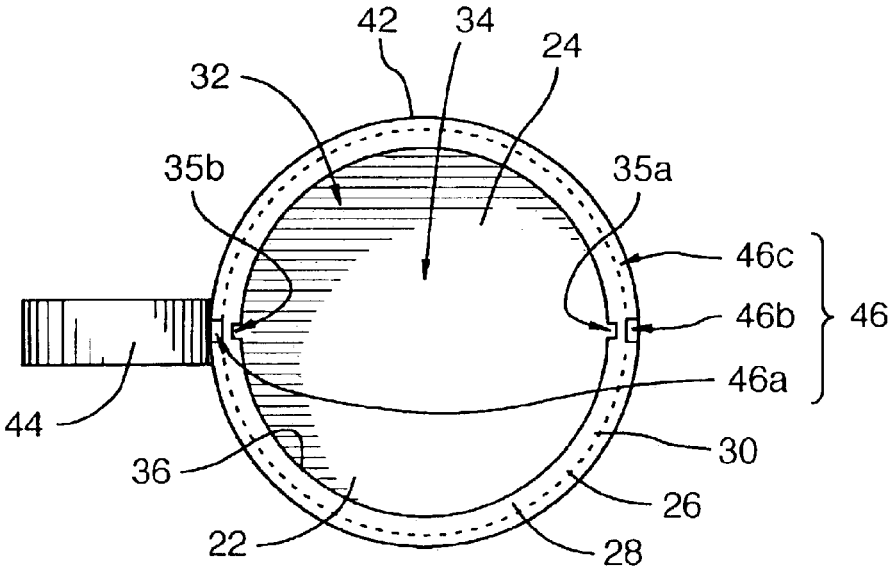
FIG. 6 is a top plan view along sight line 6—6 of FIG. 3, with an arcuate track groove of the vessel shown in dotted outline.
Figure 8:
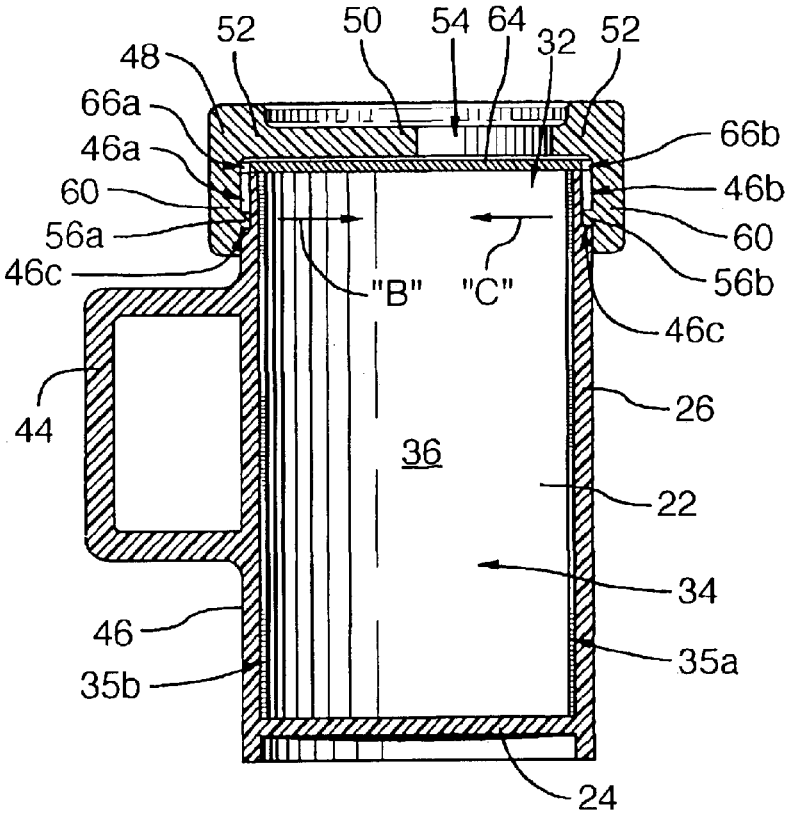
FIG. 8 is a sectional view along sight line 8—8 of FIG. 7, shown in a lid releasing configuration with the first partition member and the second partition member removed therefrom.
Figure 10:
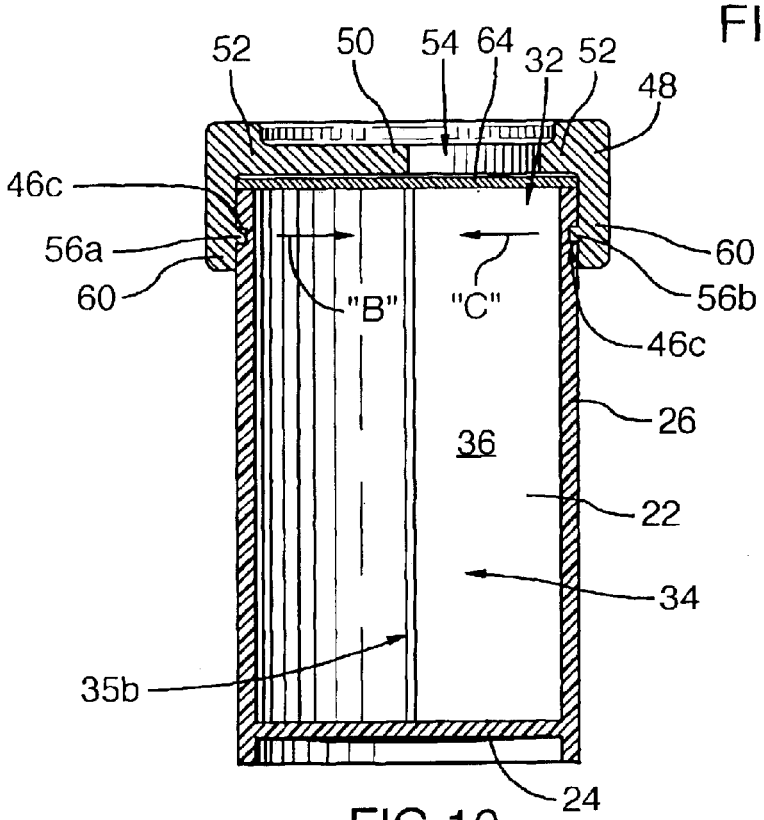
FIG. 10 is a sectional view along sight line 10—10 of FIG. 9, shown in a lid releasing configuration with the first partition member and the second partition member removed therefrom.

As best shown in FIGS. 6, 8 and 10, the vessel 22 defines a longitudinal axis "A" and has a bottom wall 24 that is planar in cross-section and circular in shape and substantially transverse to the longitudinal axis "A". The vessel 22 also has a handle member 44 extending outwardly from the vessel 22, and a continuous side wall 26 that is preferably cylindrical in shape and extends upwardly from the bottom wall 24 toward an annular rim portion 28. The rim portion 28 of the vessel 22 defines a top opening 32 to an interior 34 of the vessel 22. As best shown in FIGS. 2, 3, 6 and 8, the rim portion 28 of the vessel 22 further defines a first tongue and groove member 46 shaped in an outer wall surface 42 thereof. In the preferred embodiment best shown in FIGS. 2, 3, 6 and 8, the first tongue and groove member 46 consists of a first release groove 46*a*, a second release groove 46*b*, and an arcuate track groove 46*c*. The arcuate track groove 46*c* preferably completely circumscribes the outer wall surface 42 of the vessel 22 in substantially transverse relation to the longitudinal axis "A". Each of the first release groove 46*a* and the second release groove 46*b* is respectively elongate in shape and extends upwardly from the arcuate track groove 46*c*, parallel to the longitudinal axis "A", to a rim top portion 30 of the rim portion 28 that is adjacent to the top opening 32 of the vessel 22.

Figure 4:
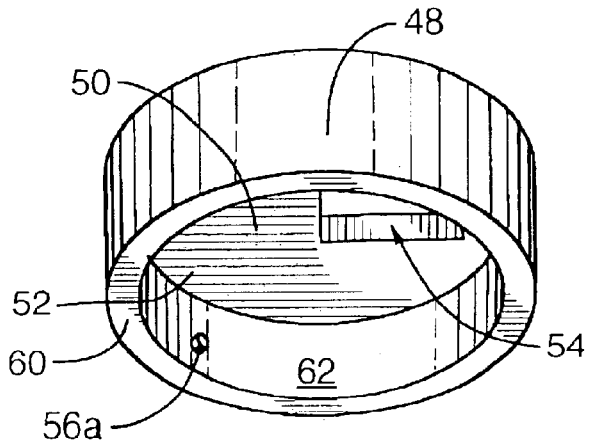
FIG. 4 is a bottom front right perspective view of the lid member of FIG. 1, shown removed from the container assembly.
Figure 5:
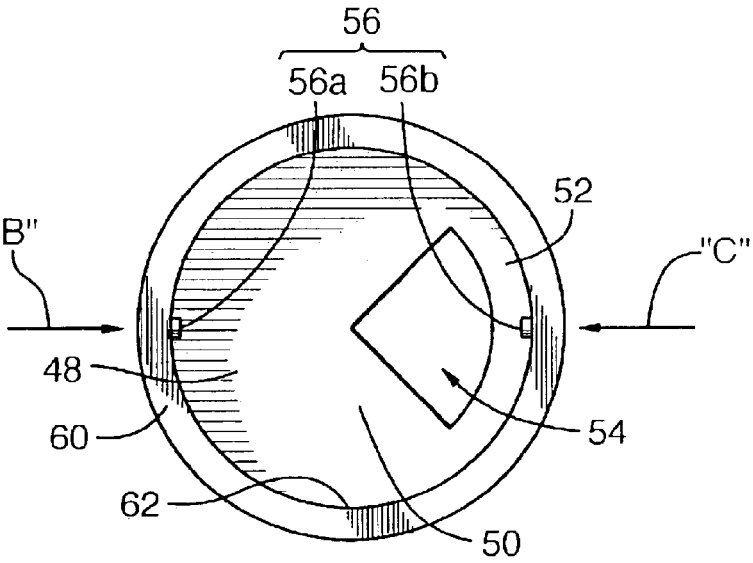
FIG. 5 is a bottom plan view of the lid member of FIG. 4.
Figure 7:
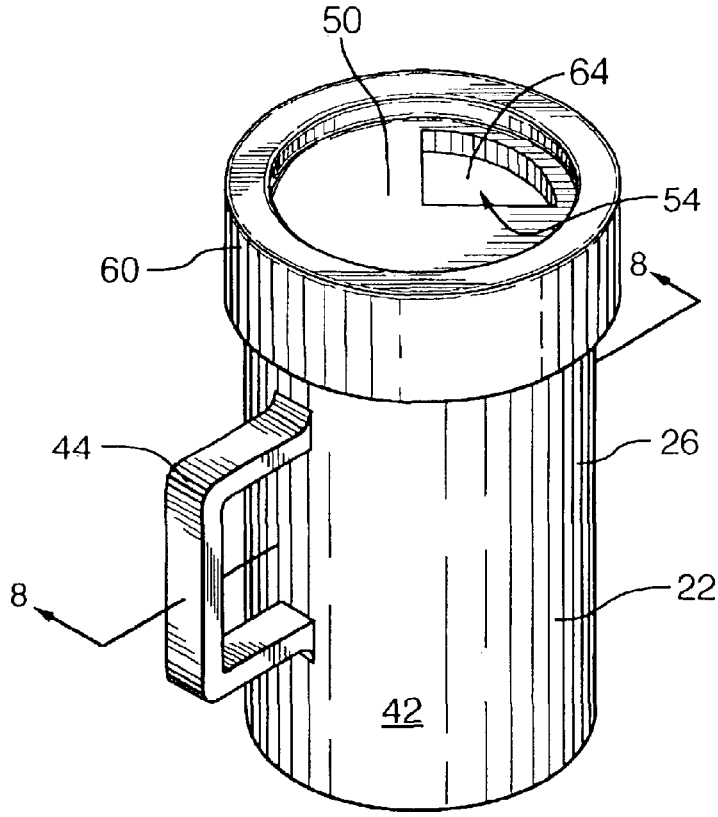
FIG. 7 is a top front left perspective view of the container assembly of FIG. 3, shown assembled in a lid releasing configuration.
Figure 9:
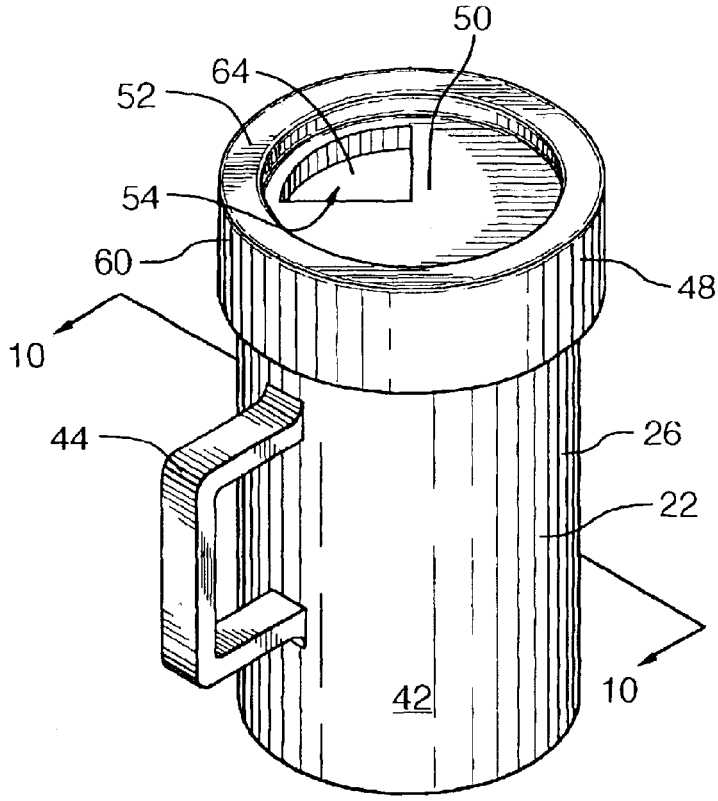
FIG. 9 is a top front left perspective view of the container assembly of FIG. 3, shown assembled in a lid secured configuration.

As best shown in FIGS. 4 and 5, the lid member 48 is preferably also circular in shape and has a perimeter lid portion 52 surrounding a circular central lid portion 50. The central lid portion 50 is preferably of planar cross-section, and defines a substantially sector shaped lid aperture 54 therethrough for accessing the interior 34 of the vessel 22. In the preferred embodiment shown, the perimeter lid portion 52 of the lid member 48 has a downwardly directed and completely circumscribing skirt portion 60 that has an inner skirt surface 62. The inner skirt surface 62 defines a complementary mating second tongue and groove member 56. The complementary mating second tongue and groove member 56 is rotatable with the lid member 48 about the longitudinal axis "A" and relative to the first tongue and groove member 46 of the vessel 22, between a lid secured configuration (as best seen in FIGS. 9 and 10) and a lid releasing configuration (as best seen in FIGS. 7 and 8), which configurations are described more fully below.

In the preferred embodiment shown, the second tongue and groove member 56 consists of a first tongue member 56*a* and a second tongue member 56*b* that extend from the inner skirt surface 62 in a first substantially inward direction "B" and a second substantially inward direction "C" respectively. In FIG. 5, the first and second substantially inward directions, "B" and "C" respectively, are shown to be substantially radial in direction. As best seen in FIG. 10, the first and second tongue members, 56*a* and 56*b* respectively, are shaped and dimensioned to fully engage the arcuate track groove 46*c* in the lid secured configuration. The first and second tongue members 56*a*, 56*b*, together with the lid member 48, are fully and slidably rotatable relative to the arcuate track groove 46*c* of the vessel 22. As best seen in FIGS. 5, 6 and 8, the first and second tongue members 56*a*, 56*b* are respectively further shaped and dimensioned so as to be aligned with, and removably and slidably passable through, the first and second release grooves 46*a*, 46*b* respectively of the vessel 22 in the lid releasing configuration.

Figure 2:
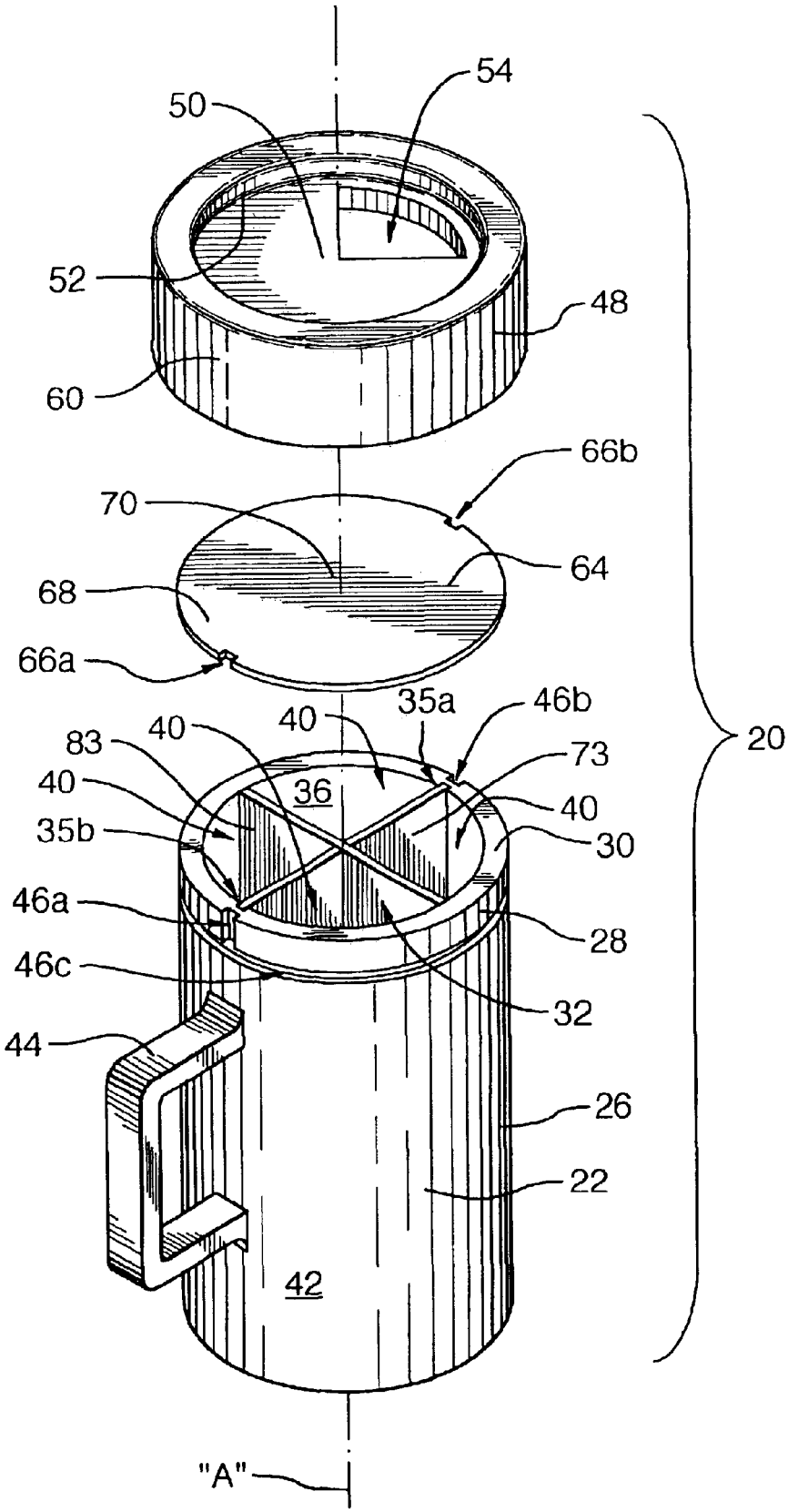
FIG. 2 is a top front left perspective partially exploded view of the container assembly of FIG. 1 on a larger scale.
Figure 3:
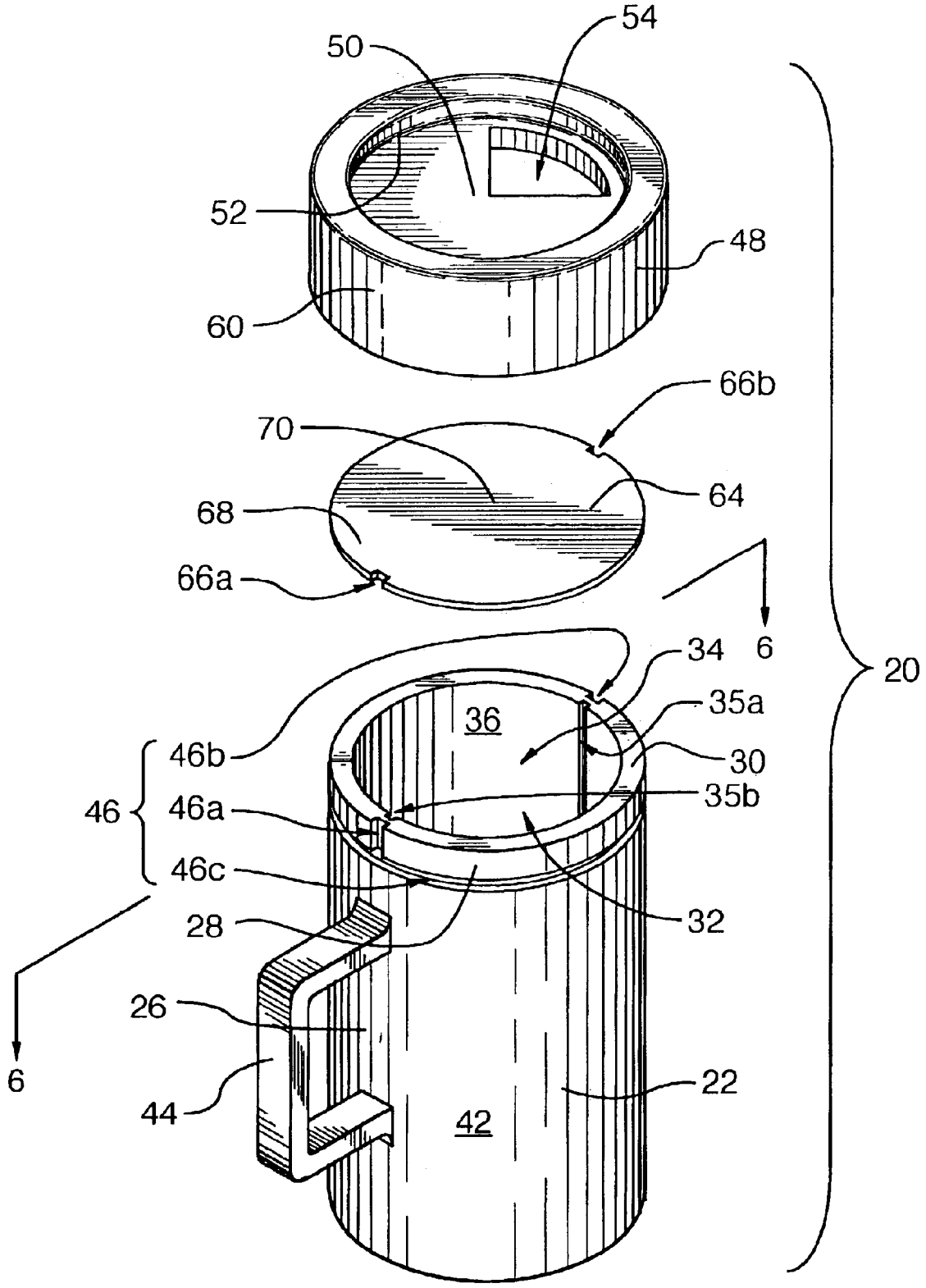
FIG. 3 is a top front left perspective partially exploded view of the container assembly of FIG. 2, shown with certain components removed therefrom for ease of illustration.

FIGS. 1 through 3 show the preferable planar cross-section and substantially circular shape of the blocking member 64 and its transverse orientation relative to the longitudinal axis "A". The blocking member 64 will also be seen to have a perimeter blocking portion 68 surrounding a circular central blocking portion 70. With specific reference now to FIGS. 8 and 10, it will be seen that the perimeter blocking portion 68 is interposed between the rim portion 28 and the perimeter lid portion 52 of the lid member 48 in juxtaposed relation. In the lid secured configuration best shown in FIG. 10, the perimeter blocking portion 68 is interposed between the rim portion 28 and the perimeter lid portion 52 of the lid member 48 in sealed and fully obstructed relation with respect to the interior 34 of the vessel 22. In the lid secured configuration, the container assembly 20 is thus sealed so as to provide for the effective, secure and safe storage of food items and beverages. The central blocking portion 70 is in overlying relation with the top opening 32 of the vessel 22, and the central lid portion 50 is, in turn, in overlying relation with the central blocking portion 70 of the blocking member 64. The central blocking portion 70 is interposed in sealed and fully obstructed relation between the lid aperture 54 and the interior 34 of the vessel 22.

The perimeter blocking portion 68 of the blocking member 64 has a first perimeter aperture 66*a* and a second perimeter aperture 66*b* therethrough, such that the perimeter blocking portion 68 is shaped so as to be substantially congruent with the outer wall surface 42 of the vessel 22 adjacent the rim top portion 30. The first and second perimeter apertures 66*a*, 66*b* are aligned with, and permit passage of, the first and second tongue members 56*a*, 56*b* of the lid member 48, when further aligned with the first and second release grooves 46*a*, 46*b* of the vessel 22, in the lid releasing configuration (as best shown in FIG. 8).

It should be noted that, in the preferred embodiment, with respect to the longitudinal axis "A", the first tongue member 56*a*, the first release groove 46*a*, and the first perimeter aperture 66*a* of the blocking member 64 are respectively in substantially diametrically opposed relation with the second tongue member 56*b*, the second release groove 46*b*, and the second perimeter aperture 66*b* of the blocking member 64. Further, according to this preferred embodiment, and in the lid releasing configuration shown in FIG. 8, each of the first and second tongue members 56*a*, 56*b* is removably passable through either of the first release groove and the first perimeter aperture, 46*a* and 66*a* respectively, or the second release groove and the second perimeter aperture, 46*b* and 66*b* respectively. In this manner, the lid releasing configuration will be seen to comprise at least a first lid releasing configuration (as best shown in FIG. 8) and a second lid releasing configuration (not shown), such that the lid member 48 may be even more easily removed from the vessel 22.

As best shown in FIGS. 1 and 2, the first partition member 73 and the second partition member 83 are each respectively substantially planar in cross-section and substantially rectangular in shape, having a respective first lateral edge portion 75*a*, 85*a*, a respective second lateral edge portion 75*b*, 85*b*, a respective upper edge portion 77*a*, 87*a*, and a respective lower edge portion 77*b*, 87*b*. As well, the first and second partition members 73, 83 are respectively further shaped so as to define a first longitudinal aperture 79 and a second longitudinal aperture 89 respectively therethrough. In the preferred embodiment of the first partition member 73 shown in FIG. 1, the first longitudinal aperture 79 extends from a transverse center of its upper edge portion 77*a* slightly past a longitudinal center of the first partition member 73 toward its respective lower edge portion 77*b*. In the preferred embodiment of the second partition member 83 shown in FIG. 1, the second longitudinal aperture 89 extends from a transverse center of its lower edge portion 87*b* slightly past a longitudinal center of the second partition member 83 toward its respective upper edge portion 87*a*. In this manner, the first longitudinal aperture 79 is adapted to slidably and removably engage the second partition member 83, whilst the second longitudinal aperture 89 is adapted to slidably and removably engage the first partition member 73.

As best shown in FIG. 2, the first and second partition members 73, 83 are interposed between the bottom wall 24 and the central blocking portion 70 of the blocking member 64. With reference now to FIGS. 1 and 2, each of the respective first and second lateral edge portions 75*a*, 75*b*, 85*a*, 85*b* of each of the first and second partition members 73, 83 will be seen to slidably engage an inner wall surface 36 of the interior 34 of vessel 22. In this manner, the first and second partition members 73, 83 together define four substantially separate compartments 40 of a substantially equal size to each other within the interior 34 of vessel 22. It should be noted that the first and second partition members 73, 83 may be shaped such that the width between the first and second lateral edge portions 75*a*, 75*b* of the first partition member 73 equals the corresponding width between the respective first and second lateral edge portions 85*a*, 85*b* of the second partition member 83, and such that the first and second partition members 73, 83 may be interchanged with respect to one another within the container assembly 20.

In the embodiment of the invention best shown in FIGS. 3, 8 and 10, the inner wall surface 36 of the interior 34 of the vessel 22 has a first elongate channel 35*a* and a second elongate channel 35*b* formed therein. Preferably, the first and second elongate channels 35*a*, 35*b* are each respectively in parallel and diametrically opposed relation with one another and relative to the longitudinal axis "A". Further, the first and second elongate channels 35*a*, 35*b* are respectively adapted to receive the first and second lateral edge portions, 75*a* and 75*b* respectively, of the first partition member 73 in sliding and removably secured relation. It should be noted that the container assembly 20 may be provided without either or both of the first and second elongate channels 35*a*, 35*b*, and/or the assembly 20 may be provided such that the inner wall surface 36 of the assembly 20 may be slightly non-cylindrical in shape, so as to accommodate first and second partition members 73, 83 of equal width to one another, as contemplated in one of the aforementioned embodiments of the invention.

In use, and as aforesaid, each of the first partition member 73, the second partition member 83, the blocking member 64, and the lid member 48 is selectively removable from the container assembly 20. The lid secured configuration, as best shown in FIG. 10, is such that the first and second tongue members, 56*a* and 56*b* respectively, fully engage the arcuate track groove 46*c*, as aforesaid, so as to prevent longitudinal movement of the lid member 48 relative to the vessel 22. Conversely, and as best shown in FIG. 8, in the lid releasing configuration, the first and second tongue members, 56*a* and 56*b* respectively, are aligned with, and removably passable through, both the first and second release grooves 46*a*, 46*b* of the vessel 22 and the first and second perimeter apertures 66*a*, 66*b* of the blocking member 64. In this manner, the lid releasing configuration permits longitudinal movement of the lid member 48 relative to the vessel 22, such that the lid member 48 is then removable therefrom.

The blocking member 64 may be removed from the vessel 22 when the lid member 48 is removed from the container assembly 20. With the blocking member 64 so removed from the container assembly 20, the four compartments 40 in the interior of the vessel may be filled with as many as four different types of food items, without any significant intermingling thereof. The blocking member 64 may then be replaced on the vessel 22 with the first and second perimeter apertures 66*a*, 66*b* aligned with the first and second release grooves 46*a*, 46*b*, so as to allow the lid member 48 to be replaced on the container assembly 20 with the first and second tongue members 56*a*, 56*b* passing therethrough. With the first and second tongue members 56*a*, 56*b* engaging the first and second release grooves 46*a*, 46*b*, the blocking member 64 may be rotated about the longitudinal axis "A" of the vessel 22, such that the first and second perimeter apertures 66*a*, 66*b* are no longer aligned with the first and second release grooves 46*a*, 46*b* as aforesaid. The lid member 48 may be easily rotated from the lid releasing configuration to the lid secured configuration, so as to once again interpose the perimeter blocking portion 68 of the blocking member 64 between the rim portion 28 and the perimeter lid portion 52 of the lid member 48 in juxtaposed relation, and in sealed and fully obstructed relation with respect to the interior 34 of the vessel 22. In this manner, the container assembly 20 is easily sealable so as to provide for the effective, secure and safe storage of food items. As well, the container assembly 20 will likewise be seen to thus allow for easy and substantially separate storage of a plurality of types of food items therewithin.

Once the blocking member 64 has been removed from the container assembly 20, the lid member 48 may alternately be directly replaced on the vessel 22 so as to allow access to the interior 34 thereof. Without the blocking member 64, the substantial sector shape of the lid aperture 54 allows it to be rotatably positionable, with rotation of the lid member 48, in substantially overlying relation with any selected one of the compartments 40. In this manner, the container assembly 20 allows for an easy, efficient and selective dispensing of individual types of food items, as selected from the plurality of such types as may be stored therewithin. As well, because the lid aperture 54 is also rotatably positionable with rotation of the lid member 48 so as to be in substantially overlying relation with any selected adjacent two of the compartments 40, the assembly 20 further allows for a mixed or blended or alternate dispensing of different food items that may be stored in adjacent compartments 40. The container assembly 20, with its multiple compartments 40, significantly reduces the risk of spillage or accidental loss of food items therefrom since, in the preferred embodiment, no more than two compartments 40 may be accessed at any one time. For this reason, among other, the container assembly 20 will be seen to be very simple and easy to use.

The second partition member 83 may be removed from the container assembly 20, and from the first partition member 73, through the top opening 32 when the lid member 48 and the blocking member 64 are each respectively removed from the vessel 22. With the second partition member 83 so removed from the container assembly 20, the first partition member 73 will, on its own, define only two substantially separate longitudinal compartments (not shown), and the two compartments in the interior 34 of the vessel 22 may then be filled with as many as two different types of food items, without any significant intermingling thereof. The lid member 48, and possibly the blocking member 64, may then be replaced on the container assembly 20 so as to provide either for the effective, secure, safe, and substantially separate storage, or for the efficient and selective dispensing, of different individual types of food items as may be stored therewithin.

Similarly, the first partition member 73 may be removed from the container assembly 20 through the top opening 32 when the lid member 48 and the blocking member 64 are each respectively removed from the vessel 22. With the first partition member 73 so removed from the container assembly 20, the interior 34 of the vessel 22 will be undivided as best shown in FIG. 3, and it may then be filled with food items or beverages. The lid member 48, and possibly the blocking member 64, may then be replaced on the container assembly 20 so as to provide either for the effective, secure, safe, and substantially separate storage, or for the efficient and selective dispensing, of the food items or beverages as may be stored therewithin.

It will be noted that, by easily rotating the lid member 48, relative to the vessel 22, from the lid secured configuration (as best shown in FIG. 9) to the lid releasing configuration (as best shown in FIG. 7), the lid member 48 may be easily removed therefrom, thus further allowing for the easy disassembly of the container assembly 20. It will also be noted that the container assembly 20 is compact and makes an efficient use of space to store a plurality of different food items, thus requiring relatively little storage space. In the preferred embodiment, the container assembly 20 is constructed from materials that are selected for their durable and reliable properties so as to be freezer, microwave, and dishwasher safe. With its relatively simple design, the container assembly 20 also has a reliable construction, and is inexpensive and easy to manufacture.

Various other modifications and alterations may be used in the design and manufacture of the container assembly for storing and dispensing food items and beverages according to the present invention without departing from its spirit and scope which is limited only by the accompanying claims. For example, an outer skirt surface of the lid member 48 might be provided with straight coarse knurled grooves shaped therein (not shown), or other gripping means, to allow for even still easier rotation of the lid member 48 relative to the vessel 22.

In another example, the continuous side wall 26 might be other than substantially cylindrical in shape, with only the rim portion 28 being so shaped. Instead of the specified slidable relationship of the tongue members 56*a*, 56*b* relative to release grooves 46*a*, 46*b* and the arcuate track groove 46*c*, the components might engage each other in a notched movable relationship. The same is also possible of the partition members 73, 83 with respect to the inner wall surface 36 of the vessel 22 and with respect to each other. As well, the vessel 22 might instead be provided with first and second tongue portions, with the lid member 48 being provided with first and second release grooves and an arcuate track groove.

In a still further example of a potential modification, with respect to the longitudinal axis "A", the first and second tongue members 56*a*, 56*b*, the first and second release grooves 46*a*, 46*b*, and the first and second perimeter apertures 66*a*, 66*b* might be other than in substantially diametrically opposed relation with respect to one another, so as to provide for only a single lid releasing configuration. Alternately, the container assembly 20 might be provided with more or less than two tongue members, release grooves, and perimeter apertures. Obviously, the lid member 48, the vessel 22, and the blocking member 64 might each be provided with any number of visual indicators or markings thereon to assist in aligning the respective tongue members, release grooves, and perimeter apertures with each other. The lid member 48 may be provided with a circumferential non-drip seal to aid a user in drinking from container assembly 20 with the lid member 48 in place thereon. Such a non-drip seal might take any number of forms, including, without limitation, seals incorporating the use of "O"-ring gaskets.

By way of yet another example, the lid aperture 54 might be bigger or smaller than that indicated in the accompanying figures, or it might be of a non-sector shape. As well, the container assembly 20 might be provided with more than two partition members. Likewise, the compartments 40 might be completely sealed with respect to one another. As well, the first and second tongue and groove connection members of the container assembly 20 might instead specify bayonet mounting of the lid member 48 on the vessel 22. The release grooves and the arcuate track groove could instead be shaped on the inner wall surface 36 of the vessel 22, with complementary tongue members extending from the perimeter lid portion 52 of the lid member 48. As well, the first and second substantially inward directions of the first and second tongue members 56*a*, 56*b* respectively might be other than substantially radial in direction.

In another example of potential modification, the compartments might other than of a substantially equal size with one another. The second partition member might be laterally offset with respect to the first partition member, or the first and second elongate channels might be in other than diametrically opposed relation with one another. Likewise, the elongate channels need not be parallel to the longitudinal axis "A". In a still further example, the second partition member might define cross-sectional compartments instead of longitudinal ones.

Obviously, the present invention allows for a wide variety of different possible combinations of the various modifications and alterations specifically contemplated herein, and as such, it should perhaps be noted once again that the present invention is limited only by the accompanying claims.

The embodiments of the invention in which an exclusive property or privilege is claimed are defined as follows:

1. A container assembly for storing and dispensing food items and beverages, said assembly comprising:

a) a vessel defining a longitudinal axis, a bottom wall, and a continuous side wall extending upwardly from said bottom wall toward a substantially annular rim portion, with said rim portion defining a top opening to an interior of said vessel, and with said rim portion being shaped and dimensioned so as to define a first tongue and groove member; and b) a selectively removable lid member having a perimeter lid portion surrounding a substantially circular central lid portion, said perimeter lid portion engaging said rim portion of said vessel in substantially juxtaposed relation, said central lid portion being in substantially overlying relation with said top opening of said vessel, with said central lid portion defining a lid aperture therethrough for accessing said interior of said vessel, and with said perimeter lid portion of said lid member being shaped and dimensioned so as to define a complementary mating second tongue and groove member that is rotatable with said lid member about said longitudinal axis and relative to said first tongue and groove member of said vessel between a lid secured configuration and a lid releasing configuration, with said lid secured configuration being such that said tongue and groove members fully engage one another so as to prevent longitudinal movement of said lid member relative to said vessel, and with said lid releasing configuration being such that said tongue and groove members are configured with respect to one another so as to permit longitudinal movement of said lid member relative to said vessel, and such that said lid member is removable from said vessel in said lid releasing configuration.

2. An assembly according to claim 1, wherein said assembly further comprises a selectively removable blocking member having a perimeter blocking portion surrounding a central blocking portion, said perimeter blocking portion substantially interposed in juxtaposed relation between said rim portion and said perimeter lid portion of said lid member, and said central blocking portion being in substantially overlying relation with said top opening of said vessel, and substantially interposed in at least partially obstructing relation between said lid aperture and said interior of said vessel, with said blocking member being removable when said lid member is removed from said container assembly.

3. An assembly according to claim 2, wherein said assembly further comprises a selectively removable first partition member engaging an inner wall surface of said interior of said vessel so as to define at least two substantially separate longitudinal compartments within said interior, with said first partition member being substantially interposed between said bottom wall and said central lid portion of said lid member, such that said lid aperture of said central lid portion is selectively and rotatably positionable, with rotation of said lid member in the lid secured configuration, to be in substantially overlying relation with respect to each of said compartments, and with said first partition member being removable through said top opening when said lid member and said blocking member are each respectively removed from said vessel.

4. An assembly according to claim 3, wherein said assembly further comprises a selectively removable second partition member removably engaging said first partition member and said inner wall surface of said vessel so as to together define at least three substantially separate longitudinal compartments within said interior, with said second partition member also being substantially interposed between said bottom wall and said central lid portion of said lid member, and being removable through said top opening when said lid member and said blocking member are each respectively removed from said vessel.

5. An assembly according to claim 4, wherein said first tongue and groove member of said vessel defines an arcuate track groove and a first release groove, with said arcuate track groove at least partially circumscribing said rim portion of said vessel in substantially transverse relation to said longitudinal axis, and with said first release groove extending substantially upwardly from said arcuate track groove to a rim top portion of said rim portion that is substantially adjacent to said top opening of said vessel, and wherein said complementary mating second tongue and groove member of said lid member comprises a first tongue member extending from said perimeter lid portion, with said first tongue member being shaped and dimensioned to fully engage said arcuate track groove in said lid secured configuration, and being further shaped and dimensioned so as to be aligned with, and removably passable through, said first release groove of said vessel in said lid releasing configuration.

6. An assembly according to claim 5, wherein said arcuate track groove and said first release groove are each respectively shaped in said rim portion in an outer wall surface of said vessel, and wherein said perimeter lid portion further comprises a downwardly directed skirt portion, with said skirt portion having an inner skirt surface, and with said first tongue member extending from said inner skirt surface in a first substantially inward direction.

7. An assembly according to claim 6, wherein said inner wall surface of said interior of said vessel has formed therein a first elongate channel adapted to receive a first lateral edge portion of said first partition member in removably secured relation.

8. An assembly according to claim 7, wherein said inner wall surface of said interior of said vessel has formed therein a second elongate channel adapted to receive a second lateral edge portion of said first partition member in removably secured relation.

9. An assembly according to claim 8, wherein said first elongate channel and said second elongate channel of said inner wall of said vessel are each respectively substantially parallel to said longitudinal axis.

10. An assembly according to claim 9, wherein said first elongate channel is in substantially diametrically opposed relation with said second elongate channel relative to said longitudinal axis.

11. An assembly according to one of claim 6 or 10, wherein said first partition member and said second partition member are each respectively substantially planar in cross-section and substantially rectangular in shape, each having a respective upper edge portion and a respective lower edge portion.

12. An assembly according to claim 11, wherein said first partition member and said second partition member are respectively further shaped so as to define a first longitudinal aperture and a second longitudinal aperture respectively therethrough, with said first longitudinal aperture extending from said upper edge portion of said first partition member part way toward its said respective lower edge portion, and with said second longitudinal aperture extending from said lower edge portion of said second partition member part way toward its said respective upper edge portion, such that said first longitudinal aperture is adapted to removably engage said second partition member as aforesaid whilst said second longitudinal aperture is adapted to removably engage said first partition member, such that said at least three substantially separate compartments comprise four substantially separate compartments, with said second partition member being removable from said first partition member through said top opening when said lid member and said blocking member are each respectively removed from said vessel.

13. An assembly according to claim 12, wherein said perimeter blocking portion of said blocking member is shaped so as to define a first perimeter aperture therethrough, with said first perimeter aperture being aligned with, and permitting passage of, said first tongue member of said lid member, when further aligned with said first release groove of said vessel, in said lid releasing configuration.

14. An assembly according to claim 13, wherein said arcuate track groove of said vessel completely circumscribes said outer wall surface of said vessel, such that said second tongue and groove member together with said lid member is fully rotatable relative to said arcuate track groove of said first tongue and groove member and said vessel.

15. An assembly according to claim 14, wherein said first tongue and groove member further defines a second release groove shaped in said rim portion in said outer wall surface of said vessel and extending substantially upwardly from said arcuate track groove to said rim top portion of said vessel, wherein said second tongue and groove member further comprises a second tongue member extending from said inner skirt surface in a second substantially inward direction, with said second tongue member being shaped and dimensioned to fully engage said arcuate track groove in said lid secured configuration, and wherein said perimeter blocking portion of said blocking member is shaped so as to define a second perimeter aperture therethrough, such that said second tongue member is aligned with, and removably passable through, said second release groove of said vessel and said second perimeter aperture of said blocking member in said lid releasing configuration.

16. An assembly according to claim 15, wherein said blocking member is in sealed and fully obstructed relation with respect to said interior of said vessel in said lid secured configuration.

17. An assembly according to claim 16, wherein each one of said compartments is of a substantially equal size to each respective other one, wherein said lid aperture of said central lid portion is sized and shaped so as to be rotatably positionable, with rotation of said lid member, in substantially overlying relation with a selected single one of said compartments.

18. An assembly according to claim 16, wherein each one of said compartments is of a substantially equal size to each respective other one, wherein said lid aperture of said central lid portion is sized and shaped so as to be rotatably positionable, with rotation of said lid member, in substantially overlying relation with a selected adjacent two of said compartments.

19. An assembly according to claim 17, wherein said continuous side wall of said vessel is substantially cylindrical in shape, wherein said bottom wall and said blocking member are each respectively substantially planar in cross-section and circular in shape and substantially transverse to said longitudinal axis, wherein said central lid portion is substantially planar in cross-section and substantially transverse to said longitudinal axis, wherein said lid member is substantially circular in shape, and wherein said skirt portion completely circumscribes said perimeter lid portion of said lid member.

20. An assembly according to claim 19, wherein said first release groove and said second release groove are each respectively elongate in shape and substantially parallel to said longitudinal axis.

21. An assembly according to claim 20, wherein said vessel further comprises a handle member extending outwardly from said vessel.

22. An assembly according to claim 21, wherein with respect to said longitudinal axis, said first tongue member, said first release groove, and said first perimeter aperture of said blocking member are respectively in substantially diametrically opposed relation with said second tongue member, said second release groove, and said second perimeter aperture of said blocking member, such that, in said lid releasing configuration, each of said first tongue member and said second tongue member is removably passable through either of said first release groove and said first perimeter aperture or said second release groove and said second perimeter aperture of said blocking member.

* * * * *